US006325404B1

(12) United States Patent
Liard et al.

(10) Patent No.: US 6,325,404 B1
(45) Date of Patent: Dec. 4, 2001

(54) ALPINE SKI

(75) Inventors: Jean Liard, Sallanches; Jacques Cuenot, Les Praz de Chamonix, both of (FR)

(73) Assignee: Skis Dynastar, Sallanches (FR)

( * ) Notice: Subject to any disclaimer, the term of this patent is extended or adjusted under 35 U.S.C. 154(b) by 0 days.

(21) Appl. No.: 09/470,507

(22) Filed: Dec. 22, 1999

(30) Foreign Application Priority Data

Dec. 23, 1998 (FR) ..... 98 16513

(51) Int. Cl.[7] ..... A63C 5/00

(52) U.S. Cl. ..... 280/607; 280/602; 280/617; 280/618

(58) Field of Search ..... 280/602, 607, 280/609, 617, 618, 636

(56) References Cited

U.S. PATENT DOCUMENTS

| | | | | |
|---|---|---|---|---|
| 5,125,680 | * | 6/1992 | Bejean et al. | 280/615 |
| 5,301,965 | * | 4/1994 | Floreani | 280/600 |
| 5,413,371 | * | 5/1995 | Trimble | 280/602 |
| 5,474,321 | * | 12/1995 | Pritz | 280/607 |
| 5,651,560 | * | 7/1997 | Stepanek et al. | 280/602 |
| 5,803,478 | * | 9/1998 | Gavalis | 280/601 |
| 5,871,223 | | 2/1999 | Zanco . | |

FOREIGN PATENT DOCUMENTS

| | | |
|---|---|---|
| 0 744 194 A 1 | 11/1996 | (EP) . |
| 532059 | 6/1939 | (GB) . |

* cited by examiner

*Primary Examiner*—Lanna Mai
*Assistant Examiner*—Christopher Buchanan
(74) *Attorney, Agent, or Firm*—Wall Marjama & Bilinski, LLP

(57) ABSTRACT

An alpine ski includes a board for gliding which has a zone for attaching a ski boot binding assembly on its upper face, which assembly includes a toe stop and a heel binding. A thickness of the board at a front portion of the zone is greater than a thickness of the board at a rear portion of the zone so that the front portion is elevated with respect to the rear portion. A rigid plate, located on the board in the zone, has a front part for attaching the toe stop and a rear part for attaching the heel binding. The front part of the rigid plate is rigidly secured to the front portion of the zone. The rear part of the rigid plate overlies the rear portion of the zone and is separated from the upper face of the rear portion by a gap for permitting relative movement between the board and the rear part of the rigid plate.

11 Claims, 5 Drawing Sheets

ALPINE SKI

FIELD OF THE INVENTION

The invention relates to the field of sports involving gliding over snow, more particularly to that of alpine skiing. Specifically, it relates to an improvement of the structure of such skis intended for receiving a platform for raising and unbracing the ski.

BACKGROUND OF THE INVENTION

As is known, in alpine skiing, the gliding equipment consists principally of an actual board for gliding on which a zone for fitting the binding is normally defined. This zone for fitting the binding receives a safety binding consisting of a toe stop and a heel binding capable of interacting with the toe and the heel of a ski boot, respectively. This zone for fitting the binding is centered with respect to the point for fitting the mid-point of the boot.

Many skis are sharply waisted and are thus relatively narrow in the median zone corresponding to the zone for fitting the binding.

Due to this narrowness, the boot comes into contact with the snow when the ski is sharply tilted during turning stages. To solve this problem, it has been proposed to equip skis with a raising platform on which the two toe-stop and heel-binding parts of the binding are fitted.

Moreover, it is known that the boards have a specific mechanical structure which confers on them certain mechanical properties of rigidity in flexion and in torsion.

In point of fact, when the binding is fitted directly to the board, the assembly formed by the toe stop and the heel binding of the binding enclosing the rigid sole of the boot braces the board by modifying its intrinsic stiffness characteristics.

It is known to place bindings on a raised platform which is itself fixed to the ski. This stacking gives rise to displacements of the rocking and pitching type with respect to the top of the ski, which may adversely affect the effective transmission of forces.

It follows that the behavior of the assembly in flexion and in torsion differs markedly from the theoretical behavior corresponding to the intrinsic qualities of the board alone.

One problem which the invention proposes to solve is that of unbracing the ski, in other words the problem of interference between the rigidity of the binding/boot assembly and the intrinsic rigidity of the board.

Unbracing of this type must allow firm attachment of the boot by means of the binding and thus make it possible to retain, irrespective of the flexion and torsion status of the board, a constant gap between the toe stop and the heel binding of the safety binding.

Moreover, it has been observed that it is essential for the toe stop to allow effective transmission of the forces from the skier's foot to the board for gliding and, more precisely, toward the edges so that the behavior of the ski is efficient and responsive. In other words, it is important for the toe stop to be firmly and directly secured to the board.

Given the different thickness characteristics of the board and the increasingly significant forces exerted in the case of recreational and competitive alpine skiing, it is thus appropriate for the toe stop of the binding to be firmly and deeply anchored in the board for gliding.

The invention thus aims to solve all these problems.

SUMMARY OF THE INVENTION

The invention thus relates to an alpine ski comprising:

- a board for gliding having an upper face including a zone for fitting the binding which is centered with respect to the point for fitting the mid-point of the boot;
- a rigid plate, located on the board in the zone for fitting the binding, capable of receiving a safety binding composed of a toe stop and of a heel binding which are mounted on the front part and on the rear part, respectively, of the plate.

This ski is noteworthy in that:

- the thickness of the board for gliding in the front portion of the zone for fitting the binding is greater than the thickness of the board for gliding in the rear portion of the zone for fitting the binding;
- the front part of the plate is secured to the upper face of the board for gliding in the raised front portion of the zone for fitting the binding;
- the rear part of the plate is located above the rear portion of the zone for fitting the binding and is free from relative movement vis-à-vis the ski in the rear portion of the zone for fitting the binding in the longitudinal direction of the ski.

In other words, this ski has a different thickness in the zone for fitting the toe stop of the binding compared with the thickness of the zone for fitting the heel binding of the binding. The upper surface of the board in this zone thus has a stepped surface.

It is this stepped zone which forms the raising thickness and the bearing point of the platform on the board. Thus, the front part of the plate supporting the toe stop of the binding may be firmly anchored in the thickest zone of the ski, whereas its rear part forming the top of the platform supporting the heel binding of the binding is not rigidly connected to the ski.

The screws connecting the heel binding to the plate are never anchored in the ski, whereas the screws connecting the toe stop to the plate may, by passing through the plate, be anchored in the ski in order to form the rigid connection.

The association of the toe stop and the thin plate forms a relatively nondeformable assembly capable of directly transferring the forces from the skier's feet toward the edges of the ski, thus guaranteeing maximum precision in the behavior of the ski.

In a first embodiment, the rear part of the plate is floating relative to the rear of the zone for fitting the binding. In other words, in this variant, the rear of the plate overhangs the top of the ski.

When the board bends, particularly during a turn, the zones located at the toe stop and the heel binding come closer together. It is thus important to allow the ski the freedom to deform. By fixing the heel binding on a detached plate in this zone to the upper surface of the ski, the invention guarantees total unbracing of the latter.

In a second embodiment, the rear part of the plate is mounted with the ability to slide relative to the board.

The ski may also include a wedge interposed between the rear part of the plate and the portion of the ski corresponding to the rear of the zone for fitting the binding. This wedge is capable of sliding with respect to the ski in the rear part of the zone for fitting the binding. Therefore, the plate does not overhang and allows good transmission of the forces exerted from the boot toward the ski.

According to a variant embodiment, this wedge has apertures which are elongate in the longitudinal direction of the ski. These apertures are intended for receiving guide lugs fitted to the ski in the rear portion of the zone for fitting the binding in order to allow the displacement of said wedge in a longitudinal direction, while retaining good lateral centering. The connecting screws of the heel binding pass through the plate and grip into the wedge without reaching the ski.

Therefore, when the ski bends, for example when a turn is commenced or when passing over a hollow, the wedge and thus the heel binding of the binding moves back with respect to a reference point of the board, while the toe stop/heel binding distance remains constant.

In this case, a substantially constant gap between the platform and the upper face of the board is maintained.

In a variant embodiment, the wedge may have recesses intended to lighten it. Advantageously, the ends of the screws for fitting the heel binding are housed inside these recesses, thus preventing their contact with the wedge.

In another embodiment, the plate has a rear end which is curved downward and includes a segment parallel to the upper face of the board, this segment being capable of sliding relative to the rear portion of the zone for fitting the binding.

In this case, the aforesaid segment may include apertures interacting with studs fitted in the board as already explained.

In another embodiment, the wedge interposed between the plate and the upper face of the ski may be made from a deformable material, for example an elastomeric material, to allow the displacement of the rear part of the plate with respect to the ski by means of the deformation by shearing of the material of which the wedge is made.

In this embodiment, the lower surface of the rear part of the plate and the upper surface of the ski in the rear part of the zone for fitting the bindings are fixed, for example by adhesive bonding, to an elastomeric material, i.e. a material that is capable of deforming in shear. Thus, when the plate, and, more precisely, its rear part, is displaced relative to the upper face of the ski, the wedge or the stud made from elastomeric material deforms and thus dampens some of the ski's deformation movements in flexion.

In an improved form of the invention, the ski also includes return means capable of opposing the sliding of the rear part of the plate. In other words, when the ski bends in flexion and when the wedge or the plate slides rearward relative to the ski, the return means give rise to the very rapid return of the board to its natural position, when the cause of the deformation no longer exists.

This assisted return movement contributes to making the board more dynamic and improves the behavior of the ski, particularly when slaloming.

In practice, these return means may consist, in particular, of springs interposed between a stop located on the upper surface of the ski and a stop located on the plate.

These return means may consist of elastic or even hyper-elastic buffers or studs working in compression.

If the board has an upper surface with a specific geometry, the lower face of the plate may have a complementary shape allowing the good transmission of forces and loads.

BRIEF DESCRIPTION OF THE DRAWINGS

The manner in which the invention is implemented and the advantages arising therefrom will become clearly apparent from the following description of embodiments with the aid of the appended figures, in which.

DETAILED DESCRIPTION OF THE INVENTION

Figure 1:
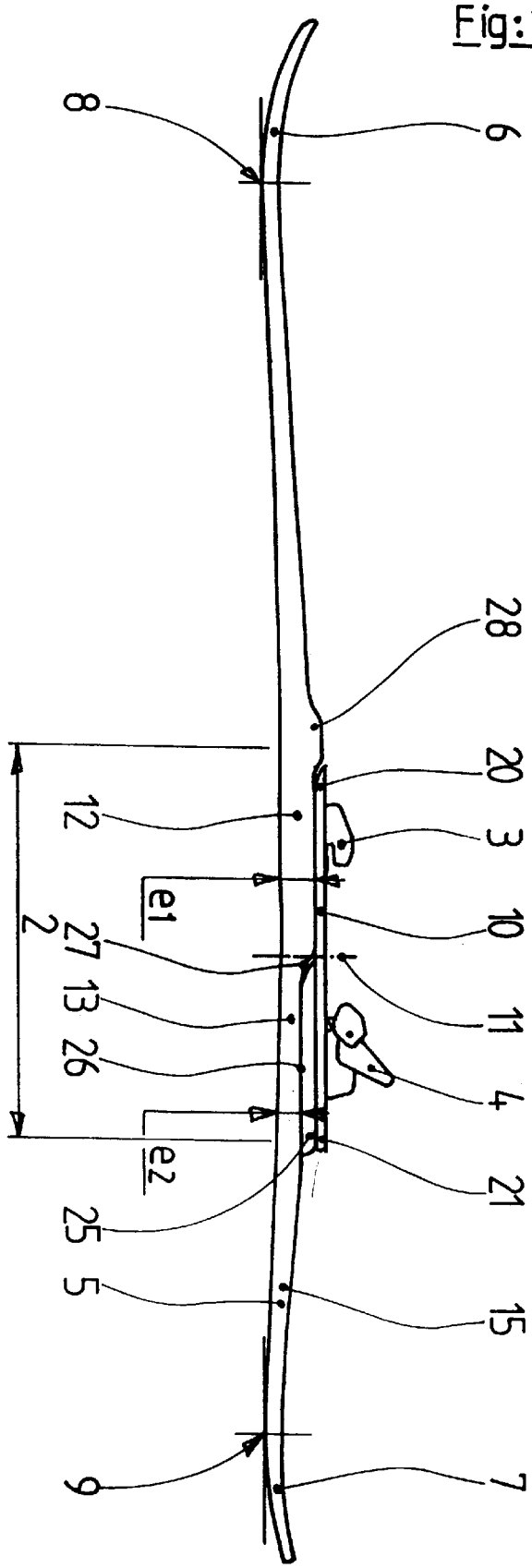
FIG. 1 is a side view of a ski produced according to a first embodiment of the invention.

As seen illustrated in FIG. 1, the ski (1) according to the invention is noteworthy in the zone for fitting the binding. This zone (2) for fitting the binding is defined normally and corresponds to the zone in which the toe stop (3) and the heel binding (4) of the binding are fitted to the board (5).

As already stated, the zone for fitting the binding has a length between 30 and 50% of the bearing length of the ski, which is defined between the front (8) and rear (9) contact lines as illustrated in FIG. 1.

In front of the front contact line (8) is the tip (6), while to the rear of the rear contact line (9) is the heel (7) of the ski.

Thus, in accordance with the invention, the ski (1) includes a rigid plate (10) on which the toe stop (3) and the heel binding (4) of the binding are fitted, for example by screwing. This plate (10) may, for example, be a metallic plate four millimeters thick.

According to the invention, the plate (5) has a difference in thickness between the front and the rear in the zone (2) for fitting the binding. Thus, as illustrated in FIG. 1, the front portion (12) of the zone (2) for fitting the binding has a thickness ($e_1$) which is markedly greater than the thickness ($e_2$) of the board (5) in the rear portion (13) of the zone (2) for fitting the binding.

The thickness ($e_2$) of the board (5) in the rear (13) of the zone (2) for fitting the binding corresponds, by continuity, to the thickness of a standard board (5) in the rear part (15) of the runner part, i.e. approximately 15 mm whereas the thickness ($e_1$) is approximately 25 mm.

According to the invention, the front part (20) of the plate (10) is fitted rigidly to the front portion (12) of the zone (2) for fitting the binding which forms an excess thickness.

This fitting may be carried out directly by means of the specific screwing of the plate or by the screwing of the toe stop of the binding through the plate which then extends as far as into the inner structure of the board.

According to one embodiment of the invention, the rear part (21) of the plate (10) is capable of sliding relative to the board (5) in order to unbrace the ski, in other words not to confer on the general stiffness of the ski a fraction inherent in the stiffness of the sole of the boot.

In the embodiment illustrated in FIG. 1, the rear part (21) of the plate (10) rests on a slide (25) which is itself in contact via its lower face (26) with the upper face of the board. This slide (25) may be profiled at the front in order to match the shape of the gradient (27) of the thickness-change zone of the board (5).

Figure 2:
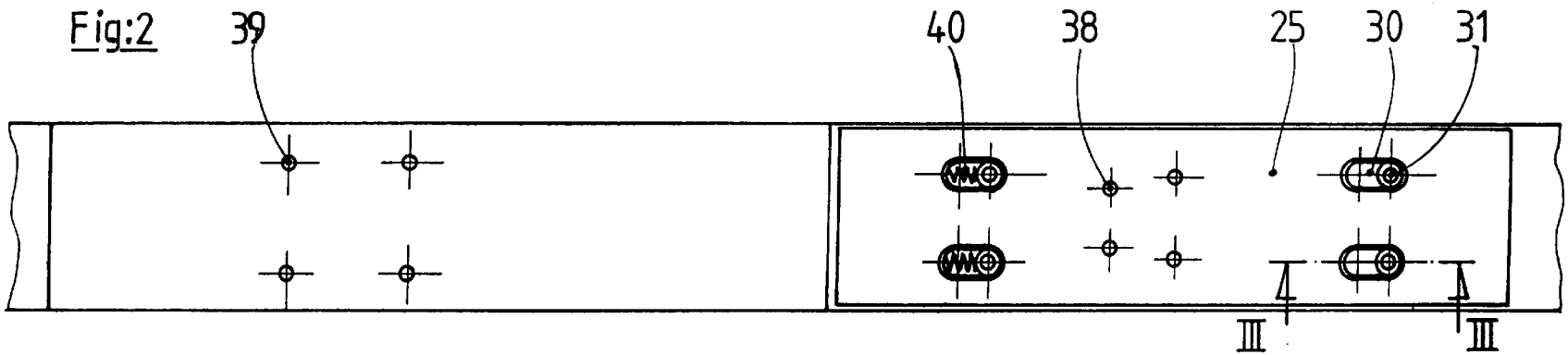
FIG. 2 is a detailed top view of the ski illustrated in FIG. 1, in the running zone, and in which the plate forming a platform has been removed.
Figure 3:
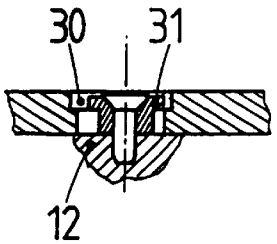
FIG. 3 is a section along III—III in FIG. 2.
Figure 4:
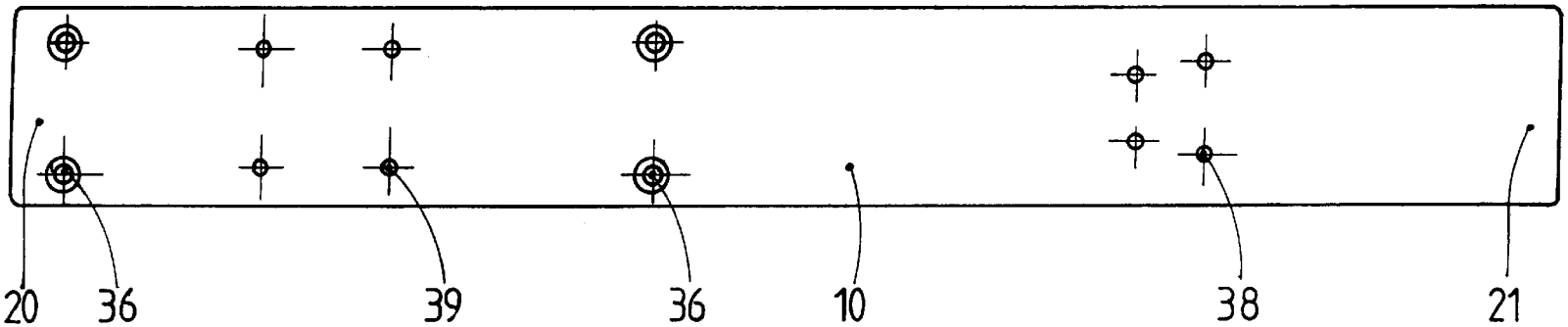
FIG. 4 is a view of the plate alone removed in FIG. 2.

According to the invention, the rear part (21) of the plate (10) is secured to the slide (25) by any known fastening means, particularly, in the case of FIGS. 2 to 4, by means of the holes (38) for fitting the heel binding.

Conversely, the slide (25) is mounted slideably with respect to the board (5) to allow unbracing of the ski.

As may be seen in FIG. 2, this slide (25), of generally rectangular shape, has oblong apertures (30) inside which lugs (31) integral with the upper face of the board penetrate. Naturally, the geometry and the number of apertures and of lugs are not limited to the embodiment illustrated, but may be adapted as a function of the materials used and the general dimensions of the wedge.

According to FIG. 3, these lugs (31) are shouldered in order to maintain the application of the slide (25) against the ski, despite the latter's bending.

According to FIG. 4, the plate (10) may optionally have a plurality of screw holes (39, 38) for fitting the toe stop (3) and the heel binding (4). This plate (10) also has, at the front (20), screw holes (36) allowing it to be anchored firmly in the thick part (12) of the zone (2) for fitting the binding. Advantageously, the screw holes (36) of the heel binding are tapped while the screw holes (38, 39) of the toe stop are not necessarily tapped.

As already stated, this securing of the plate to the board may also be achieved by means of the screw holes (39) of the toe stop (3) of the binding, according to FIGS. 2 to 4.

As illustrated in FIG. 2, the apertures have a return means, for example a spring (40) which, working in compression, opposes the displacement of the slide (25) relative to the ski.

These springs (40) or, more generally, the return members exert an effect on the ski which makes the latter more dynamic, for example when exiting a turn. Indeed, in the case where a pressure is exerted on the ski in such a manner as to cause it to bend by flexion, the slide (25) being rigidly connected (38) to the plate (10), this assembly and the binding/boot assembly undergoing no modification in length, there is a relative displacement of the rear zone (13) for fixing the binding, more specifically of the studs (31) connected to the ski relative to the apertures (30) of the slide. It ensues that the springs (40) are compressed. When the momentum of the skier during the tight part of the turn disappears, the return members (40) accelerate the backward movement of the ski (13) relative to the plate (10) or, in other words, bring the board (5) into a more planar configuration.

Naturally, the return members may be produced in a wide variety of ways and are not limited to the embodiment of FIG. 2 corresponding to springs.

Figure 8:
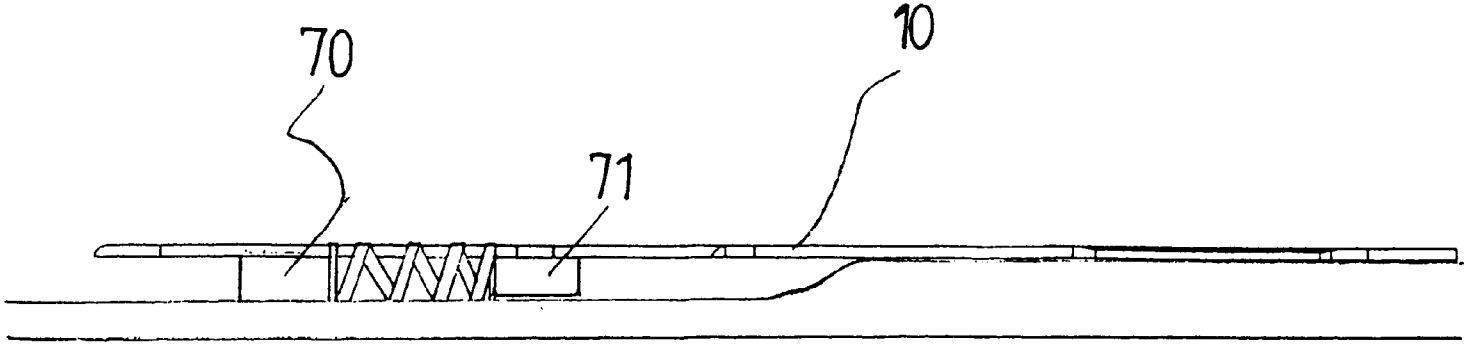
FIG. 8 is a side view of the running zone of a ski according to another variant embodiment.
Figure 9:
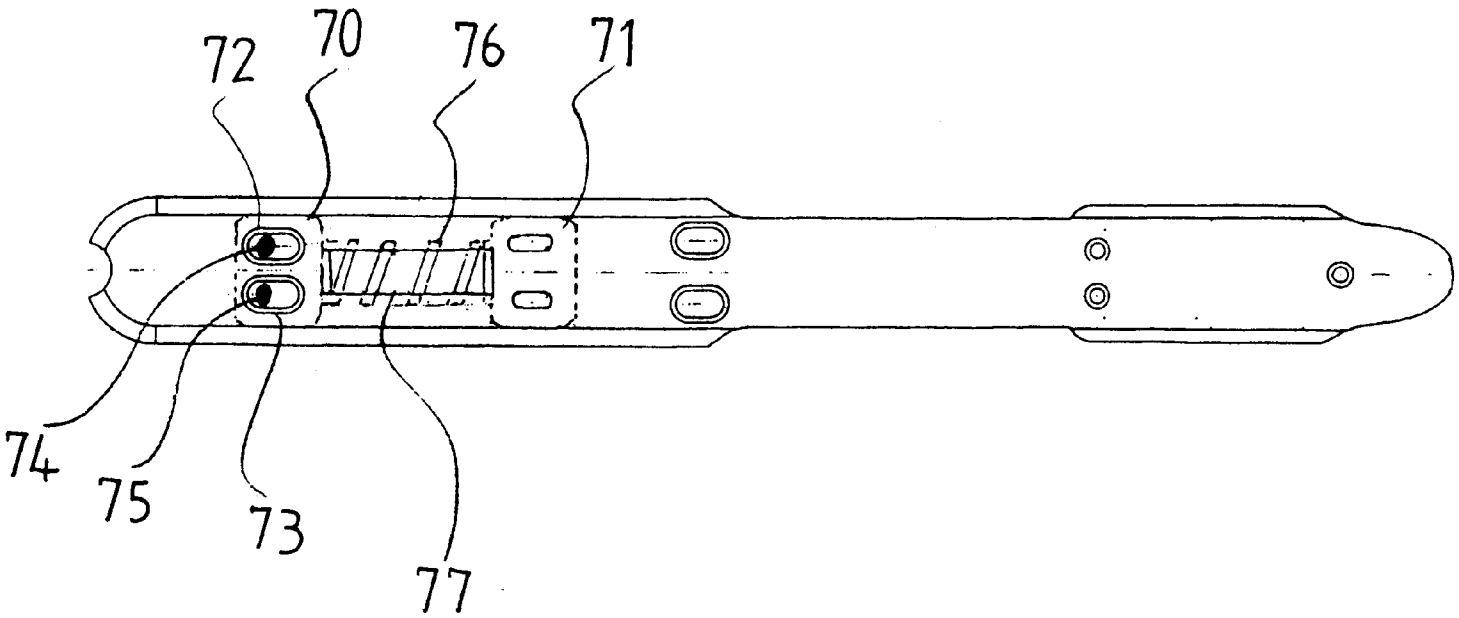
FIG. 9 is a top view of FIG. 8.

In the embodiment illustrated in FIGS. 8 and 9, the plate (10) has, under its lower face, in its rear zone, two wedges (70, 71), one (70) of which is integral with the board while the other (71) is integral with the lower face of the plate (10).

The rear wedge (70) has, on its upper face, screws or lugs (74, 75) with shoulders intended to penetrate in the apertures (72, 73) provided on the plate (10). These lugs (74, 75) are intended for preventing any transverse displacement of the plate (10) and for longitudinally guiding the plate (10) during bending of the board. The shoulders of the lugs (74, 75) prevent the upward displacement of the plate (10).

The wedge (71) is secured to the plate (10) by screwing or any appropriate means.

The space between the wedges (70) and (71) houses a spring (76) working in compression, the ends of which come into contact with the wedges (70) and (71).

In the embodiment shown, the plate (10) includes an opening (77) making it possible to see the compression status of the spring.

Thus, when the board bends, during momentum at the commencement of a turn, the rear part of the platform (10) tends to move back relative to the upper face of the board.

The high ends of the lugs (74, 75) slide inside the apertures (72, 73) guiding the longitudinal displacement of the plate (10).

It ensues that the front wedge (71) moves back in the same manner relative to the upper face of the board and, in particular, relative to the wedge (70), which is integral therewith.

In succession, the spring (76) is compressed during the bending of the board.

When the momentum exerted by the skier diminishes or ceases, the ski tends to resume its initial configuration. In this, it is aided by the spring (76) which, by decompressing, gives rise to the separation of the wedges (70, 71) and thus accelerates the return of the ski to its initial geometry.

The invention is not limited to the embodiment illustrated in FIG. 1, but encompasses other variants in which the rear part of the platform is not mounted slidably relative to the upper face of the board but is simply fitted so as to overhang or float relative to this upper face of the board.

Figure 5:
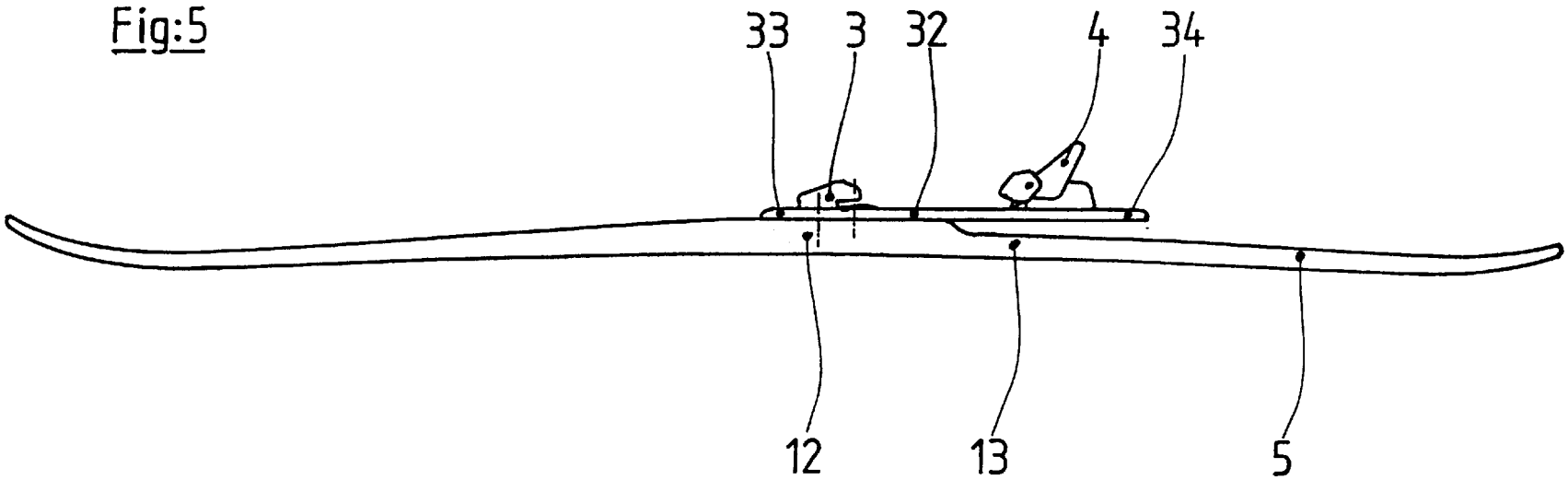
FIG. 5 is a side view of a ski produced according to a second embodiment of the invention.

Thus, as illustrated in FIG. 5, the plate (32) may be fixed in its front part (33) to the front zone (12) for fitting the bindings of the ski (5), while the rear part (34) of the plate overhangs above the rear zone (13) for fitting the bindings.

Figure 6:
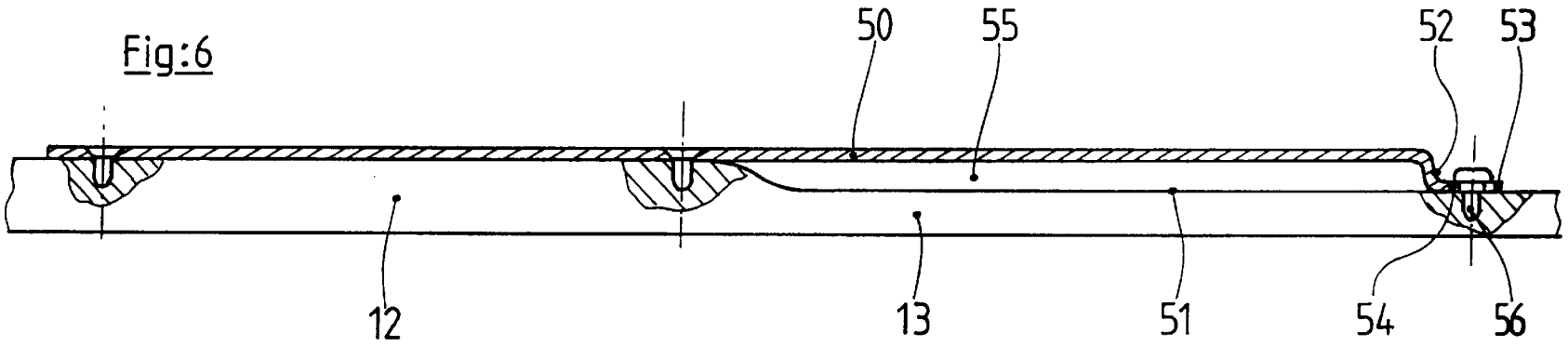
FIG. 6 is a detailed sectional view of the zone for fitting the binding of a ski produced according to a third embodiment.

As illustrated in FIG. 6, the plate (50) may rest directly on the upper face (51) of the ski, at its rear end (52). To do so, the rear end (52) of the plate is inclined downward and has a segment (53) which rests on the upper face (51) of the ski in the rear zone for fitting the bindings.

In other words, the space (55) located between the plate (50) and the upper face (51) of the ski in the thinnest part (13) of the zone (2) for fitting the binding may be hollowed out. Preferably, a space of this type is filled by an easily compressible material in order to prevent the accumulation of snow.

In this case, the segment (53) forming the rear end of the plate (50) has an aperture (54) equivalent to that made in the slide (25) of the embodiment of FIG. 2. This aperture (54) receives a stud (56) firmly anchored in the structure of the board (5) to guide the displacement of the plate (50) longitudinally while allowing a certain clearance resulting from the bending of the ski.

Figure 7:
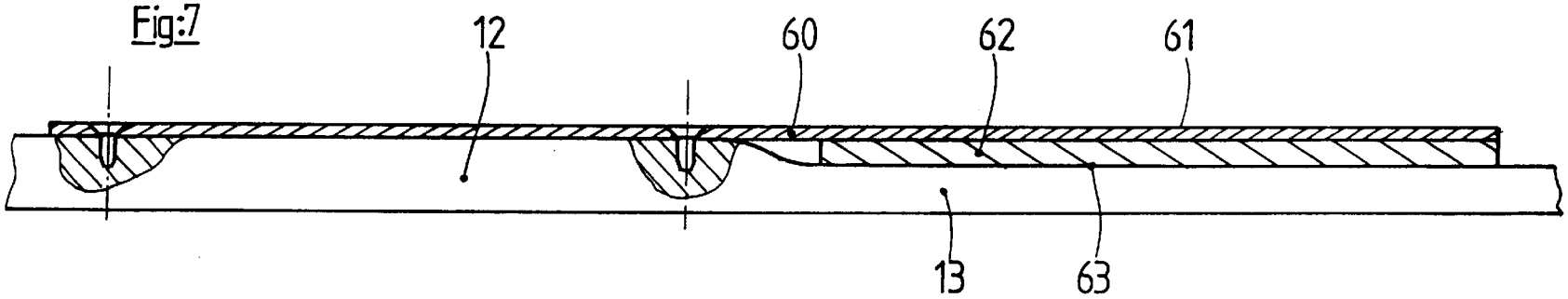
FIG. 7 is also a detailed sectional view of the zone for fitting the binding of a ski produced according to a fourth embodiment.

In another embodiment illustrated in FIG. 7, the rear part (61) of the plate (60) rests on an elastomeric projection (62) capable of deforming when the ski bends.

The elastomeric projection (62) is fixed under the plate (60) and on the upper face (63) of the ski to allow good lateral guiding of the plate (60) during its movements relative to the board.

If this projection is produced from a viscoelastic material, it makes it possible to ensure a certain vibration damping. If this projection is produced from an elastic or even a hyper-elastic material, it then makes it possible to make the ski slightly more dynamic.

In an embodiment illustrated in FIG. 1, the zone (2) for fitting the binding extends forward in a protuberance (28) of supplementary thickness, substantially equivalent to the thickness of the plate forming the platform, in order to integrate the latter in an aesthetic manner.

Therefore, the platform (10) is integrated into the upper face of the ski and does not jut out, which avoids the risk of injury.

It arises from the aforesaid that the ski according to the invention has multiple advantages and particularly provides good unbracing of the ski while allowing firm and very rigid securing of the toe stop of the binding with respect to the board, giving the ski great precision. Moreover, it is possible to obtain either damping of the ski or, alternatively, greater responsiveness which is very useful in competition use.

What is claimed is:

1. An alpine ski (1) comprising:

a board (5) for gliding having an upper face including a zone (2) for attaching a ski boot binding assembly which includes a toe stop and a heel binding, a thickness ($e_1$) of the board (5) at a front portion (12) of the zone being greater than a thickness ($e_2$) of the board (5) at a rear portion (13) of the zone to provide a front portion which is elevated with respect to the rear portion; and a rigid plate (10, 32, 50, 60) located on the board in the zone for attaching the ski boot binding assembly, the rigid plate having a front part configured for the attachment of the top stop thereto and a rear part configured for the attachment of the heel binding thereto, the front part (20, 33) of the rigid plate being rigidly secured to the upper face of the front portion of the zone for attaching the ski boot binding assembly; wherein, the rear part (21, 34, 52, 61) of the rigid plate overlies the rear portion (13) of the zone for attaching the ski boot binding assembly and is separated from the upper face of the rear portion by a gap for permitting relative movement between the board and the rear part of the rigid plate.

2. The alpine ski as claimed in claim 1, wherein the rear part (34) of the plate (32) is overhanging relative to the rear portion (13) of the zone (2) for fitting the binding on the ski.

3. The ski as claimed in claim 1, wherein the rear part (21, 52, 61) of the plate (10, 50, 60) is mounted with the ability to slide over the rear portion (13) of the zone (2) for fitting the binding on the ski.

4. The ski as claimed in claim 1, wherein the rear part (61) of the plate (60) is connected to the board for gliding (5) by means of a projection (62) made from elastomeric material capable of deforming by shearing and/or by compression.

5. The ski as claimed in claim 3, which comprises, a slide (25) interposed between the rear part (21) of the plate (10) and the rear portion (13) of the zone (2) for fitting the binding, said slide (25) being capable of sliding longitudinally with respect to the ski in the rear part (13) of the zone for fitting the binding.

6. The ski as claimed in claim 5, wherein the slide (25) has apertures (30) which are elongate in the longitudinal direction of the ski and intended for receiving studs (31) mounted on the rear portion (13) of the zone (2) for fitting the binding, in order to guide the longitudinal displacement of said wedge (25) relative to the ski.

7. The ski as claimed in claim 3, wherein the plate (50) has a rear end (52) which is curved downward and comprises a segment (53) parallel to the upper face (51) of the ski, said segment (53) being capable of sliding relative to the ski in the rear portion (13) of the zone (2) for fitting the binding.

8. The ski as claimed in claim 3, which comprises, return means (40, 77) capable of opposing the sliding of the rear part (21) of the plate (10) relative to the ski in the rear portion (13) of the zone (2) for fitting the binding.

9. The ski as claimed in claim 8, wherein the return means consist of a spring (40, 77) interposed between a stop (31, 70) integral with the upper face of the ski and a stop (30, 71) integral with the plate.

10. The ski as claimed in claim 4, wherein the projection (62) is produced from a viscoelastic material.

11. The ski as claimed in claim 4, wherein the projection (62) is produced from an elastic or hyperelastic material.

* * * * *

UNITED STATES PATENT AND TRADEMARK OFFICE

CERTIFICATE OF CORRECTION

PATENT NO. : 6,325,404 B1
DATED : December 4, 2001
INVENTOR(S) : Liard et al.

It is certified that error appears in the above-identified patent and that said Letters Patent is hereby corrected as shown below:

Column 7,
Line 17, please delete the word "top" and replace with -- toe --.

Signed and Sealed this

Fourth Day of June, 2002

*Attest:*

*Attesting Officer*

JAMES E. ROGAN
*Director of the United States Patent and Trademark Office*